US011559121B2

(12) United States Patent
Paikin

(10) Patent No.: US 11,559,121 B2
(45) Date of Patent: Jan. 24, 2023

(54) GEMSTONE AND METHODS OF CUTTING THE SAME

(71) Applicant: Albert Gad Ltd., New York, NY (US)

(72) Inventor: Reuven Paikin, Windhoek (NA)

(73) Assignee: Albert Gad Ltd., New York, NY (US)

( * ) Notice: Subject to any disclaimer, the term of this patent is extended or adjusted under 35 U.S.C. 154(b) by 38 days.

(21) Appl. No.: 17/056,679

(22) PCT Filed: May 8, 2019

(86) PCT No.: PCT/US2019/031374
§ 371 (c)(1),
(2) Date: Nov. 18, 2020

(87) PCT Pub. No.: WO2019/222002
PCT Pub. Date: Nov. 21, 2019

(65) Prior Publication Data

US 2021/0219676 A1 Jul. 22, 2021

Related U.S. Application Data

(60) Provisional application No. 62/673,683, filed on May 18, 2018.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/007; A44C 17/008; A44C 17/001
(Continued)

(56) References Cited

U.S. PATENT DOCUMENTS 693,084 A * 2/1902 Townsend ..... A44C 17/001 D11/90
1,291,506 A * 1/1919 Heller ..... A44C 17/001 D11/90
(Continued)

FOREIGN PATENT DOCUMENTS

CN 101721021 A 6/2010
CN 101909476 A 12/2010
(Continued)

OTHER PUBLICATIONS

International Search Report and Written Opinion in International Application No. PCT/US2019/031374, dated Jul. 3, 2019 (10 pages).
(Continued)

*Primary Examiner* — Jack W Lavinder
(74) *Attorney, Agent, or Firm* — Nixon Peabody LLC

(57) ABSTRACT

A gemstone includes a crown, a pavilion, and a girdle disposed between the crown and the pavilion. The surface of the gemstone is generally divided into a number of groups of interlocking facets disposed at a variety of angles. The groups of facets comprising the surface of the crown generally include star facets, upper main crown facets, upper intermediate crown facets, lower main crown facets, lower intermediate crown facets, and upper girdle facets. The upper girdle facets generally abut an upper edge of the girdle. The groups of facets comprising the surface of the pavilion include culet-adjacent facets, lower candle facets, lower main pavilion facets, upper candle facets, upper main pavilion facets, and lower girdle facets. The lower girdle facets generally abut a lower edge of the girdle.

19 Claims, 7 Drawing Sheets

(58) Field of Classification Search
USPC ..... D11/90
See application file for complete search history.

(56) References Cited

U.S. PATENT DOCUMENTS

| | | | | |
|---|---|---|---|---|
| D481,649 | S * | 11/2003 | Samuels | D11/90 |
| 6,761,044 | B2 * | 7/2004 | Samuels | A44C 17/001 D11/89 |
| D511,475 | S | 11/2005 | Hirapara et al. | |
| 8,156,760 | B2 | 4/2012 | Gad | |
| 8,215,127 | B2 * | 7/2012 | Matsumura | A44C 17/001 63/32 |
| 2003/0181147 | A1 | 9/2003 | Schachter | |
| 2003/0192346 | A1 | 10/2003 | Samuels | |
| 2005/0000405 | A1 | 1/2005 | Brookshire | |
| 2007/0113586 | A1 | 5/2007 | Rydlewicz | |
| 2009/0308104 | A1 | 12/2009 | Gad | |
| 2011/0302960 | A1 | 12/2011 | Weingarten | |
| 2012/0060557 | A1 | 3/2012 | van Looveren | |
| 2015/0296934 | A1 | 10/2015 | Zhang | |
| 2016/0007699 | A1 | 1/2016 | Strnad | |

FOREIGN PATENT DOCUMENTS

| | | | |
|---|---|---|---|
| CN | 102525050 | A | 7/2012 |
| CN | 105996343 | A | 10/2016 |
| CN | 106163320 | A | 11/2016 |
| EP | 2179672 | B1 | 4/2010 |
| WO | WO 2015/155740 | A1 | 10/2015 |

OTHER PUBLICATIONS

First Office Action in Chinese Patent Application No. CN 201980033328.4, dated Mar. 29, 2022 (7 pages).
CN Office Action for Application No. 201980033328, dated Aug. 30, 2022 (6 pp.).
CN Supplemental Search for Application No. 201980033328, dated Aug. 23, 2022 (1 p.).
CN Supplemental Search for Application No. 20191980033328, dated Aug. 10, 2022 (1 p.).

* cited by examiner

GEMSTONE AND METHODS OF CUTTING THE SAME

CROSS-REFERENCE TO RELATED APPLICATION

This application is a U.S. National Stage of International Application No. PCT/US2019/031374, filed May 8, 2019, which claims priority to and the benefit of U.S. Provisional Patent Application No. 62/673,683, filed May 18, 2018, each of which is hereby incorporated by reference herein in its entirety.

TECHNICAL FIELD

The present disclosure relates to gemstones, more specifically, the present disclosure relates to a pattern of facets of gemstones.

BACKGROUND

Some gemstones are designed/cut to produce a desirable amount of brilliance, or "sparkle" by forming or cutting a number of individual facets on the exterior surface of the gemstone. Other gemstones are designed/cut to enhance a natural color (e.g., yellow, pink, etc.) of the gemstone. However, it can be difficult to produce a gemstone having a layout of facets at specific angles that produce both a desirable amount of brilliance and also enhance the natural color of the gemstone.

The present disclosure is directed to solving these problems and addressing other needs.

SUMMARY

According to some implementations of the present disclosure, the gemstone includes a crown forming an upper portion of the gemstone. The surface of the crown includes a table, a plurality of star facets, a plurality of upper main crown facets, a plurality of upper intermediate crown facets, a plurality of lower main crown facets, a plurality of lower intermediate crown facets, and a plurality of upper girdle facets. The table forms a generally horizontal upper surface of the crown. Each of the plurality of star facets is disposed adjacent to and abutting the table. Each of the plurality of upper main crown facets is disposed between two of the plurality of star facets. Each of the plurality of upper intermediate crown facets is disposed between two of the plurality of upper main crown facets. Each of the plurality of lower main crown facets is disposed adjacent to and abutting one of the plurality of upper intermediate crown facets Each of the plurality of lower intermediate crown facets is disposed adjacent to and abutting one of the plurality of upper main crown facets and disposed between two of the plurality of lower main crown facets. The plurality of upper girdle facets is formed in pairs of adjacent upper girdle facets. Each pair of the adjacent upper girdle facets is disposed between two of the plurality of lower main crown facets. The gemstone further includes a pavilion forming a lower portion of the gemstone. A surface of the pavilion includes a plurality of culet-adjacent facets, a plurality of lower main pavilion facets, a plurality of lower candle facets, a plurality of upper main pavilion facets, a plurality of upper candle facets, and a plurality of lower girdle facets. The plurality of culet-adjacent facets forms a lower point of the pavilion. Each of the plurality of lower main pavilion facets is disposed adjacent to and abutting an edge of one of the plurality of culet-adjacent facets. An upper portion of each of the plurality of lower candle facets is disposed generally between two of the plurality of lower main pavilion facets and a lower portion of each of the plurality of lower candle facets is disposed generally between two of the plurality of culet-adjacent facets. Each of the plurality of upper main pavilion facets is disposed adjacent to and abutting an edge of one of the plurality of lower main pavilion facets. Each of the plurality of upper candle facets is disposed adjacent to and abutting an edge of one of the plurality of lower candle facets. A lower portion of each of the plurality of upper candle facets is disposed generally between two of the plurality of upper main pavilion facets. The plurality of lower girdle facets is formed in pairs of adjacent lower girdle facets. Each of the pairs of adjacent lower girdle facets is disposed generally between two of the plurality of upper main pavilion facets. Each of the pairs of adjacent lower girdle facets has an upper portion of a respective one of the plurality of upper candle facets disposed generally therebetween. The gemstone further includes a girdle positioned between the crown and the pavilion and encircling the gemstone. Each of the plurality of upper girdle facets is disposed adjacent to and abutting an upper edge of the girdle. Each of the plurality of lower girdle facets is disposed adjacent to and abutting a lower edge of the girdle.

According to some implementations of the present disclosure, the gemstone includes a crown forming an upper portion of the gemstone. The surface of the crown includes a table, a plurality of star facets, a plurality of upper main crown facets, a plurality of upper intermediate crown facets, a plurality of lower main crown facets, a plurality of lower intermediate crown facets, and a plurality of upper girdle facets. The table forms a generally horizontal upper surface of the crown. Each of the plurality of star facets is disposed adjacent to and abutting the table. Each of the plurality of upper main crown facets is disposed between two of the plurality of star facets. Each of the plurality of upper intermediate crown facets is disposed between two of the plurality of upper main crown facets. Each of the plurality of lower main crown facets is disposed adjacent to and abutting one of the plurality of upper intermediate crown facets Each of the plurality of lower intermediate crown facets is disposed adjacent to and abutting one of the plurality of upper main crown facets and disposed between two of the plurality of lower main crown facets. The plurality of upper girdle facets is formed in pairs of adjacent upper girdle facets. Each pair of the adjacent upper girdle facets is disposed between two of the plurality of lower main crown facets.

According to some implementations of the present disclosure, the gemstone includes a pavilion forming a lower portion of the gemstone. A surface of the pavilion includes a plurality of culet-adjacent facets, a plurality of lower main pavilion facets, a plurality of lower candle facets, a plurality of upper main pavilion facets, a plurality of upper candle facets, and a plurality of lower girdle facets. The plurality of culet-adjacent facets forms a lower point of the pavilion. Each of the plurality of lower main pavilion facets is disposed adjacent to and abutting an edge of one of the plurality of culet-adjacent facets. An upper portion of each of the plurality of lower candle facets is disposed generally between two of the plurality of lower main pavilion facets and a lower portion of each of the plurality of lower candle facets is disposed generally between two of the plurality of culet-adjacent facets. Each of the plurality of upper main pavilion facets is disposed adjacent to and abutting an edge of one of the plurality of lower main pavilion facets. Each of the plurality of upper candle facets is disposed adjacent to and abutting an edge of one of the plurality of lower candle facets. A lower portion of each of the plurality of upper candle facets is disposed generally between two of the plurality of upper main pavilion facets. The plurality of lower girdle facets is formed in pairs of adjacent lower girdle facets. Each of the pairs of adjacent lower girdle facets is disposed generally between two of the plurality of upper main pavilion facets. Each of the pairs of adjacent lower girdle facets has an upper portion of a respective one of the plurality of upper candle facets disposed generally therebetween.

According to some implementations of the present disclosure, the gemstone includes a crown forming an upper portion of the gemstone. The surface of the crown includes a table having a generally octagonal shape, a plurality of star facets having a generally triangular shape, a plurality of upper main crown facets having a generally pentagonal shape, a plurality of upper intermediate crown facets having a generally triangular shape, a plurality of lower main crown facets having a generally pentagonal shape, a plurality of lower intermediate crown facets having a generally triangular shape, and a plurality of upper girdle facets having a generally triangular shape. The table forms a generally horizontal upper surface of the crown. Each of the plurality of star facets is disposed adjacent to and abutting the table. Each of the plurality of upper main crown facets is disposed between two of the plurality of star facets. Each of the plurality of upper intermediate crown facets is disposed between two of the plurality of upper main crown facets. Each of the plurality of lower main crown facets is disposed adjacent to and abutting one of the plurality of upper intermediate crown facets Each of the plurality of lower intermediate crown facets is disposed adjacent to and abutting one of the plurality of upper main crown facets and disposed between two of the plurality of lower main crown facets. The plurality of upper girdle facets is formed in pairs of adjacent upper girdle facets. Each pair of the adjacent upper girdle facets is disposed between two of the plurality of lower main crown facets. The gemstone further includes a pavilion forming a lower portion of the gemstone. A surface of the pavilion includes a plurality of culet-adjacent facets forming a lower point of the pavilion and having a generally pentagonal shape with a flat edge opposing the lower point of the pavilion, a plurality of lower main pavilion facets having a generally trapezoidal shape, a plurality of lower candle facets having a generally pentagonal shape, a plurality of upper main pavilion facets having a generally pentagonal shape, a plurality of upper candle facets having a generally pentagonal shape, and a plurality of lower girdle facets having four edges. Each of the plurality of lower main pavilion facets is disposed adjacent to and abutting an edge of one of the plurality of culet-adjacent facets. An upper portion of each of the plurality of lower candle facets is disposed generally between two of the plurality of lower main pavilion facets and a lower portion of each of the plurality of lower candle facets is disposed generally between two of the plurality of culet-adjacent facets. Each of the plurality of upper main pavilion facets is disposed adjacent to and abutting an edge of one of the plurality of lower main pavilion facets. Each of the plurality of upper candle facets is disposed adjacent to and abutting an edge of one of the plurality of lower candle facets. A lower portion of each of the plurality of upper candle facets is disposed generally between two of the plurality of upper main pavilion facets. The plurality of lower girdle facets is formed in pairs of adjacent lower girdle facets. Each of the pairs of adjacent lower girdle facets is disposed generally between two of the plurality of upper main pavilion facets. Each of the pairs of adjacent lower girdle facets has an upper portion of a respective one of the plurality of upper candle facets disposed generally therebetween. The gemstone further includes a girdle positioned between the crown and the pavilion and encircling the gemstone. Each of the plurality of upper girdle facets is disposed adjacent to and abutting an upper edge of the girdle. Each of the plurality of lower girdle facets is disposed adjacent to and abutting a lower edge of the girdle.

According to some implementations of the present disclosure, the gemstone includes a crown forming an upper portion of the gemstone, a pavilion forming a lower portion of the gemstone, and a girdle positioned between the crown and the pavilion and encircling the gemstone. The gemstone has a top depth percentage of between about 25% and about 35%, and a bottom depth percentage of between about 50% and about 60%.

According to some implementations of the present disclosure, the gemstone includes a crown forming an upper portion of the gemstone, a pavilion forming a lower portion of the gemstone, and a girdle positioned between the crown and the pavilion and encircling the gemstone. The gemstone has a total depth percentage of between about 86% and about 91%.

According to some implementations of the present disclosure, the gemstone includes a crown forming an upper portion of the gemstone, and a pavilion forming a lower portion of the gemstone. A surface of the crown includes a first plurality of facets, and a surface of the pavilion includes a second plurality of facets. Each facet in the first plurality of facets being disposed at an angle of between about 22° and about 55.5° relative to an upper surface of the gemstone. Each facet in the second plurality of facets being disposed at an angle of between about 38.5° and about 60° relative to the upper surface of the gemstone.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

FIG. 6F illustrates a sixth step of the method of forming the pavilion of the gemstone of FIG. 1, according to some implementations of the present disclosure.

Figure 1:
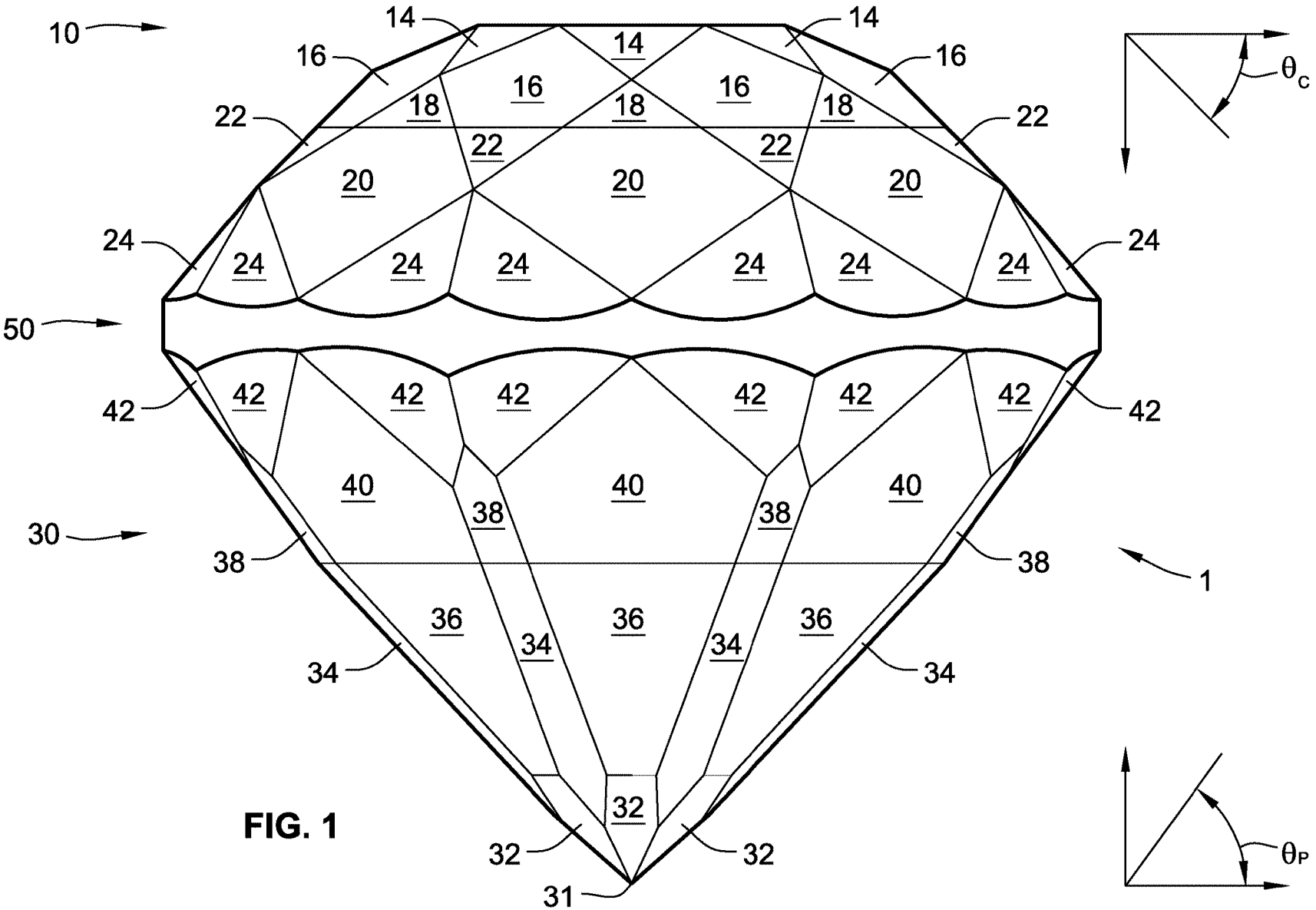
FIG. 1 is an elevation view of a gemstone, according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Referring to FIG. 1, an elevation view of an embodiment of the gemstone 1 is illustrated. The gemstone 1 is generally divided into a crown 10 located at an upper portion of the gemstone 1, a pavilion 30 located at a lower portion of the gemstone 1, and a girdle 50, which is generally disposed between the crown 10 and the pavilion 30. The girdle 50 generally encircles the entire circumference of the gemstone 1. The crown 10 generally has a flat top surface (as seen in FIG. 2A) called a table. The lower portion of the gemstone 1 at the pavilion 30 can terminate in a point 31 as shown in FIG. 1, or can terminate in a flat facet called a culet. The gemstone 1 is generally a precious stone, such as but not limited to a diamond, ruby, emerald, sapphire, or pearl. The gemstone 1 can also be a synthetic material, such as cubic zirconium. More broadly, the gemstone 1 can include any material capable of being cut, such as, for example, precious or non-precious stones, cubic zirconia, ceramic, metal, plastic, wood, etc.

The dimensional characteristics of the gemstone 1 are based off of the width of the gemstone 1. The width of the gemstone 1 can also be expressed as the diameter of the girdle 50. The gemstone 1 has a table percentage that is a measure of a width or diameter of the table of the gemstone 1. The table can be formed in a variety of shapes, as thus the measure of the width of the table can vary. In an embodiment, the table is a circle, and thus the diameter of the circle is used to express the table percentage of the gemstone 1. In another embodiment, the table is an octagon, and either the distance between opposing edges of the octagon or between opposing vertices of the octagon is used to express the table percentage. The table percentage is generally expressed as the width of the table 1 divided by the width of the gemstone 1. In an embodiment, the table percentage is between about 33% and about 36%. In a further embodiment, the table percentage is between about 30% and about 36%. In an additional embodiment, the table percentage is between about 21% and about 40%.

The gemstone 1 has a top depth percentage that is a measure of the height of the crown 10 of the gemstone 1. The top depth percentage is generally expressed as the height of the crown 10 divided by the width of the gemstone 1. In an embodiment, the top depth percentage is between about 27% and about 31%. In another embodiment, the top depth percentage is between about 25% and about 35%.

The gemstone 1 has a bottom depth percentage that is a measure of the total height of the pavilion 30 of the gemstone 1. The bottom depth percentage is generally expressed as the height of the pavilion 30 divided by the width of the gemstone 1. In an embodiment, the bottom depth percentage is between about 53% and about 56%. In another embodiment, the bottom depth percentage is between about 50% and about 60%.

The gemstone 1 has a girdle thickness percentage that is a measure of the total height of the girdle 50 of the gemstone 1. The girdle thickness percentage is generally expressed as the height of the girdle 50 divided by the width of the gemstone 1. In an embodiment, the girdle thickness percentage is between about 4.5% and about 6%. In another embodiment, the girdle thickness percentage is between about 3% and about 8%. In a further embodiment, the girdle thickness percentage is between about 2% and about 10%.

The gemstone 1 has a total depth percentage that is a measure of the total height of the gemstone 1. The total depth percentage is generally expressed as the height of the gemstone 1 divided by the width of the gemstone 1. The total depth percentage may also be expressed as the sum of the top depth percentage, the bottom depth percentage, and the girdle thickness percentage. In an embodiment, the total depth percentage is between about 86% and about 90.5%. In another embodiment, the total depth percentage is between about 80% and about 95%. In further embodiment, the total depth percentage is between about 86% and about 91%.

Referring back to FIG. 1, the surface of the gemstone 1 is generally divided into a number of groups of interlocking facets disposed at a variety of angles. The groups of facets comprising the surface of the crown 10 generally include star facets 14, upper main crown facets 16, upper intermediate crown facets 18, lower main crown facets 20, lower intermediate crown facets 22, and upper girdle facets 24. The upper girdle facets 24 generally abut an upper edge of the girdle 50. The groups of facets comprising the surface of the pavilion 30 include culet-adjacent facets 32, lower candle facets 34, lower main pavilion facets 36, upper candle facets 38, upper main pavilion facets 40, and lower girdle facets 42. The lower girdle facets 42 generally abut a lower edge of the girdle 50. In an embodiment, the girdle 50 is a continuous circular facet that encircles the entirety of the gemstone 1. In another embodiment, the girdle 50 is divided into a plurality of sub-facets. In yet another embodiment, each sub-facet of the girdle 50 comprises a plurality of individual facets. The upper edge of the girdle 50 that abuts the crown 10 may be generally straight or may be curved. The lower edge of the girdle 50 that abuts the pavilion 30 may be generally straight or may be curved.

The angles that each of the facets of the crown 10 are disposed at may be measured relative to a horizontal plane defined by the table of the gemstone 1 (e.g. the top surface of the gemstone 1). As shown in the upper set of axes in FIG. 1, each of the facets of the crown 10 is formed at an angle $\theta_C$ relative to the horizontal plane defined by the table of the gemstone 1. As is shown in FIG. 1, the angle $\theta_C$ that each of the facets of the crown 10 are disposed at is formed by rotating in a clockwise direction downward from the horizontal plane defined by the table.

In an embodiment, the angle of the star facets 14 is about 26°. In another embodiment, the angle of the star facets 14 is between about 25° and about 27°. In a further embodiment, the angle of the star facets 14 is between about 22° and about 30°.

In an embodiment, the angle of the upper main crown facets 16 is between about 32° and about 35°. In another embodiment, the angle of the upper main crown facets 16 is between about 29° and about 38°.

In an embodiment, the angle of the upper intermediate crown facets 18 is about 44°. In another embodiment, the angle of the upper intermediate crown facets 18 is between about 43° and about 45°. In a further embodiment, the angle of the upper intermediate crown facets 18 is between about 40° and about 48°.

In an embodiment, the angle of the lower main crown facets 20 is about 47°. In another embodiment, the angle of the lower main crown facets 20 is between about 46° and about 48°. In a further embodiment, the angle of the lower main crown facets 20 is between about 44° and about 50°.

In an embodiment, the angle of the lower intermediate crown facets 22 is between about 36° and about 39°. In another embodiment, the angle of the lower intermediate crown facets 22 is between about 34° and about 41°.

In an embodiment, the angle of the upper girdle facets 24 is about 52°. In a further embodiment, the angle of the upper girdle facets 24 is between about 51° and about 53°. In a further embodiment, the angle of the upper girdle facets 24 is between about 53.5° and about 55.5°. In yet another embodiment, the angle of the upper girdle facets 24 is between about 49° and about 55°.

The angles that each of the facets of the pavilion 30 are disposed at may also be measured relative to the horizontal plane defined by the table of the gemstone 1 (e.g. the top surface of the gemstone 1). As shown in the lower set of axes in FIG. 1, each of the facets of the pavilion 30 is formed at an angle $\theta_P$ relative to this horizontal plane defined by the table of the gemstone 1. As is shown in FIG. 1, the angle $\theta_P$ that each of the facets of the pavilion 10 are disposed at is formed by rotating in a counterclockwise direction upward from the horizontal plane defined by the table.

In an embodiment, the angle of the culet-adjacent facets 32 is about 42°. In another embodiment, the angle of the culet-adjacent facets 32 is between about 41° and about 42°. In a further embodiment, the angle of the culet-adjacent facets 32 is between about 39° and about 44°. In an even further embodiment, the angle of the culet-adjacent facets 32 is between about 40.7° and about 42.2°. In yet another embodiment, the angle of the culet-adjacent facets 32 is between about 38.5° and about 43°.

In an embodiment, the angle of the lower candle facets 34 is between about 44° and about 45°. In another embodiment, the angle of the lower candle facets 34 is between about 43° and about 46°. In a further embodiment, the angle of the lower candle facets 34 is between about 42° and about 47°. In a further embodiment, the angle of the lower candle facets 34 is between about 40° and about 50°.

In an embodiment, the angle of the lower main pavilion facets 36 is between about 45° and about 48°. In a further embodiment, the angle of the lower main pavilion facets 36 is between about 43° and about 50°.

In an embodiment, the angle of the upper candle facets 38 is between about 48° and about 51°. In another embodiment, the angle of the upper candle facets 38 is between about 46° and about 53°.

In an embodiment, the angle of the upper main pavilion facets 40 is between about 50° and about 53°. In a further embodiment, the angle of the upper main pavilion facets 40 is between about 45° and about 55°.

In an embodiment, the angle of the lower girdle facets 42 is between about 54.5° and about 57°. In another embodiment, the angle of the lower girdle facets 42 is between about 55° and about 58°. In a further embodiment, the angle of the lower girdle facets 42 is between about 50° and about 60°.

Figure 2:
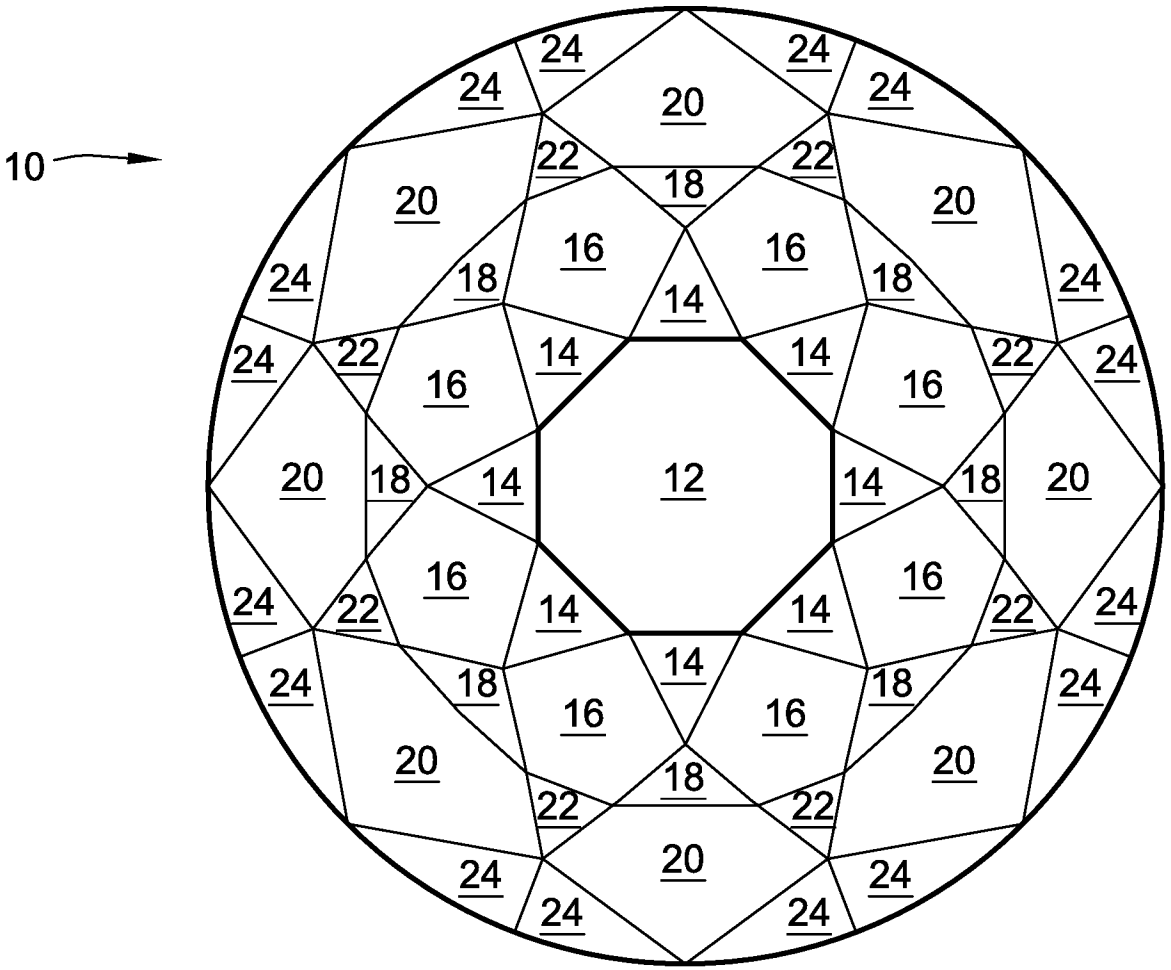
FIG. 2 is a top plan view of the gemstone of FIG. 1, according to some implementations of the present disclosure.

Referring now to FIG. 2, a top plan view of gemstone 1 is illustrated. As is shown in FIG. 2, the facets on the surface of the crown 10 share edges and vertices where the facets meet. Table 12 is a generally horizontal surface having a number of edges and is located at the top of the crown 10. In an embodiment illustrated in FIG. 2, table 12 can have a generally hexagonal shape. Other shapes for table 12 are contemplated in other embodiments. Eight star facets 14 are disposed around the table 12. Each star facet 14 has a generally triangular shape. The base of each star facet 14 abuts one of the edges of the table 12.

Eight upper main crown facets 16 are disposed between the eight star facets 14 and abutting the vertices of the table 12. Each upper main crown facet 16 has a generally pentagonal shape, and is disposed between two star facets 14. One point of each upper main crown facet 16 abuts a respective vertex of the table 12.

Eight upper intermediate crown facets 18 are disposed between the upper main crown facets 16 and abutting vertices of the star facets 14. Each upper intermediate crown facet 18 is disposed between two of the upper main crown facets 16, and has a generally triangular shape. One point of each of the upper intermediate crown facets 18 abuts a vertex of a respective one of the star facets 14. This vertex of each of the star facets 14 is generally opposite the base of each of the star facets 14 that abuts one of the edges of the table 12. An edge of each of the upper intermediate crown facets 18 opposite the vertex of the upper intermediate crown facet 18 that abuts the vertex of the star facets 14 abuts an edge of a respective one of the eight lower main crown facets 20.

Eight lower main crown facets 20 are disposed with an edge of each lower main crown facet 20 abutting an edge of a respective one of the upper intermediate crown facets 18. As shown, each lower main crown facet 20 has a generally pentagonal shape. Each lower main crown facet 20 has a first vertex that abuts a vertex of a first adjacent lower main crown facet 20, and a second vertex that abuts a second adjacent lower main crown facet 20. Each of the lower main crown facets 20 have a third vertex abutting the upper edge of the girdle. This third vertex is opposite the edge of the lower main crown facet 20 that abuts an edge of one of the upper intermediate crown facets 18.

Eight lower intermediate crown facets 22 are disposed between the lower main crown facets 20 and the upper main crown facets 16. Each lower intermediate crown facet 22 has a generally triangular shape. A first edge of each of the lower intermediate crown facets 22 abuts an edge of a respective one of the upper main crown facets 16. This edge of each of the upper main crown facets 16 is generally opposite the point of each of the upper main crown facets 16 that abuts one of the vertices of table 12. The second edge and the third edge of each lower intermediate crown facet 22 abuts an edge of the lower main crown facets 20 disposed on either side thereof.

Finally, sixteen upper girdle facets 24 are disposed between the lower main crown facets 20 and the girdle 50. Each of the upper girdle facets 24 has a generally triangular shape. A first edge of each of the upper girdle facets 24 abuts the upper edge of the girdle 50, and can be flat or curved depending on the shape of the girdle 50. As shown, two of the upper girdle facets 24 are disposed between any two of the lower main crown facets 20. A second edge of each upper girdle facet 24 abuts an edge of a single adjacent lower main crown facet 20. A third edge of each upper girdle facet 24 abuts an edge of a single adjacent upper girdle facet 24.

Figure 3:
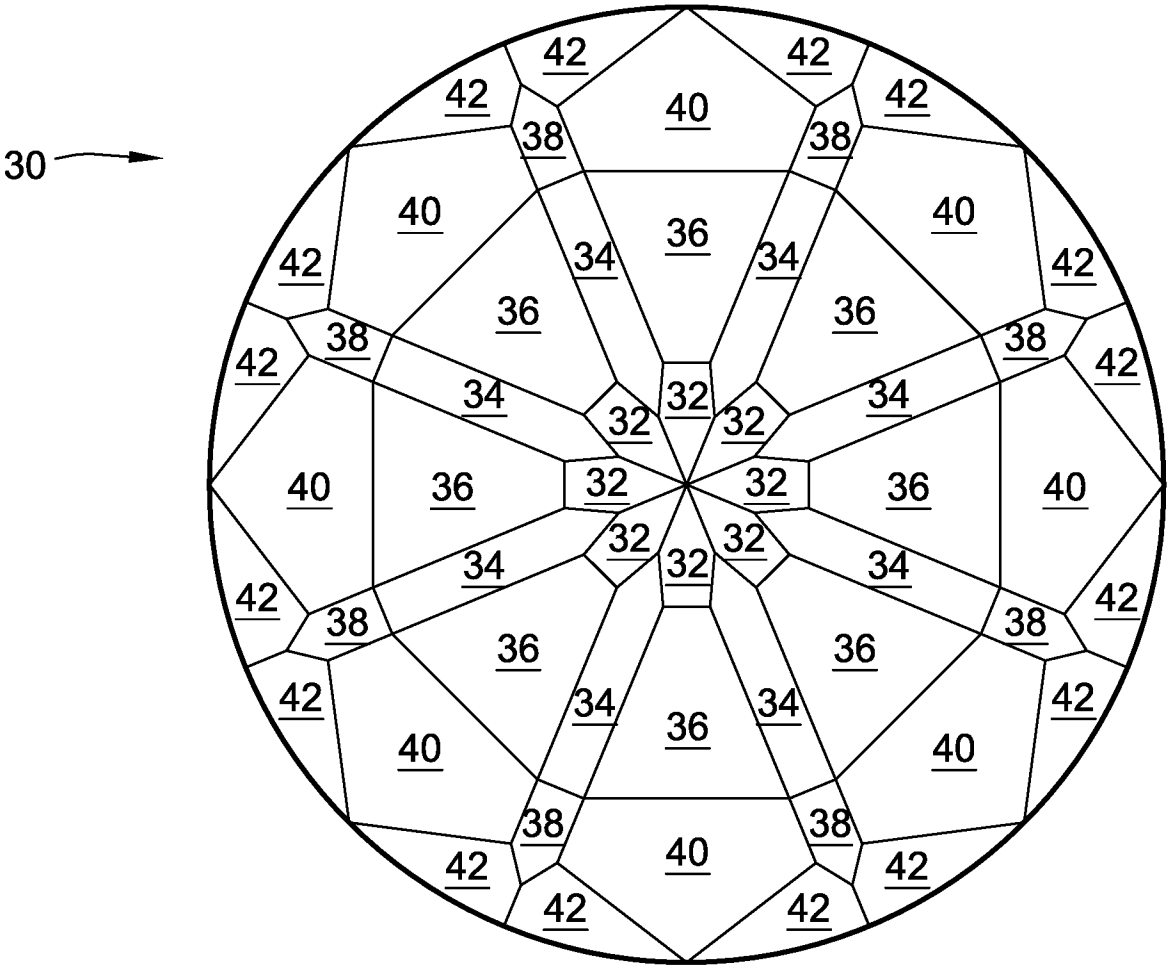
FIG. 3 is a bottom plan view of the gemstone of FIG. 1, according to some implementations of the present disclosure.

Referring now to FIG. 3, a bottom plan view of gemstone 1 showing the pavilion 30 is illustrated. Eight culet-adjacent facets 32 are formed at the lowermost portion of the pavilion 30. In some embodiments, the culet-adjacent facets 32 terminate in a culet, which is a horizontal surface forming the bottom of the pavilion 30. In the embodiment illustrated in FIG. 3, each of the culet-adjacent facets 32 has a bottom point. Together, the bottom points of each of the culet-adjacent facets 32 form the point 31 of the gemstone 1. In an embodiment, each culet-adjacent facet 32 has a generally pentagonal shape with a flat edge opposing the bottom point. In the illustrated embodiment, the bottom point of each of the culet-adjacent facets 32 meet to form a single bottom point of the gemstone 1.

Eight lower candle facets 34 are formed on the surface of the pavilion 30 and have a generally pentagonal shape similar to that of the culet-adjacent facets 32. The lower candle facets 34 extend upward (shown as radially outward in FIG. 3) from the culet-adjacent facets 32 towards the girdle 50, and have a generally horizontal edge opposite the bottom point. A bottom portion of each of the lower candle facets 34, including a bottom point, is slotted between adjacent culet-adjacent facets 32. The remainder of each of the lower candle facets 34 is slotted between adjacent lower main pavilion facets 36.

Eight lower main pavilion facets 36 are formed such that each lower main pavilion facet 36 is disposed between adjacent lower candle facets 34. Each of the lower main pavilion facets 36 has a generally trapezoidal shape with an upper horizontal edge, a lower horizontal edge, and two angled edges. As shown, the lower edge of each of the lower main pavilion facets 36 abuts an edge of a respective culet-adjacent facet 32 opposite the point 31. Each of the two angled edges of the lower main pavilion facets 36 abuts an edge of an adjacent lower candle facet 34.

The pavilion 30 further includes eight upper candle facets 38. Each of the plurality of upper candle facets 38 has a similar pentagonal shape as the culet-adjacent facets 32 and the lower candle facets 34. The upper candle facets 38 are generally sized smaller than the lower candle facets 34 and oriented in the opposite direction. The upper candle facets 38 have an upper point extending upwards toward the girdle 50 and a horizontal edge opposing the upper point. The upper point of each of the upper candle facets 38 does not contact the girdle 50 itself however. The upper point abuts a pair of adjacent lower girdle facets 42, and ends prior to reaching the girdle 50. The horizontal edge of each of the upper candle facets 38 abuts the horizontal edge of a respective one of the lower candle facets 34.

Eight upper main pavilion facets 40 are formed between the upper candle facets 38. Each upper main pavilion facet 40 is disposed between a pair of upper candle facets 38. The upper main pavilion facets 40 have a generally pentagonal shape with a lower horizontal edge and an upper point that extends upward and contacts the girdle 50. The lower horizontal edge of each of the upper main pavilion facets 40 abuts the upper horizontal edge of a respective one of the lower main pavilion facets 36. Two side edges of each of the upper main pavilion facets 40 abut edges of adjacent upper candle facets 38.

Finally, sixteen lower girdle facets 42 are disposed around an upper portion of the pavilion 30. Adjacent lower girdle facets 42 are generally formed in pairs of lower girdle facets 42. Each pair of adjacent lower girdle facets 42 are bounded by one of the upper candle facets 38, two of the upper main pavilion facets 40, and the girdle 50 itself. Each individual lower girdle facet 42 is bounded by one of the upper candle facets 38, one of the upper main pavilion facets 40, an adjacent lower girdle facet 42, and the girdle 50. Each of the lower girdle facets 42 generally has four edges. A first edge of each lower girdle facet 42 abuts the lower edge of the girdle 50. A second edge of each lower girdle facet 42 abuts an edge of one of the upper main pavilion facets 40. A third edge of each lower girdle facet 42 abuts an edge of one of the upper candle facets 38. A fourth edge of each lower girdle facet 42 abuts an edge of an adjacent lower girdle facet 42. As shown, the upper point of the upper candle facets 38 extends upward into a gap formed by the lower portions of adjacent lower girdle facets 42.

Figure 4A:
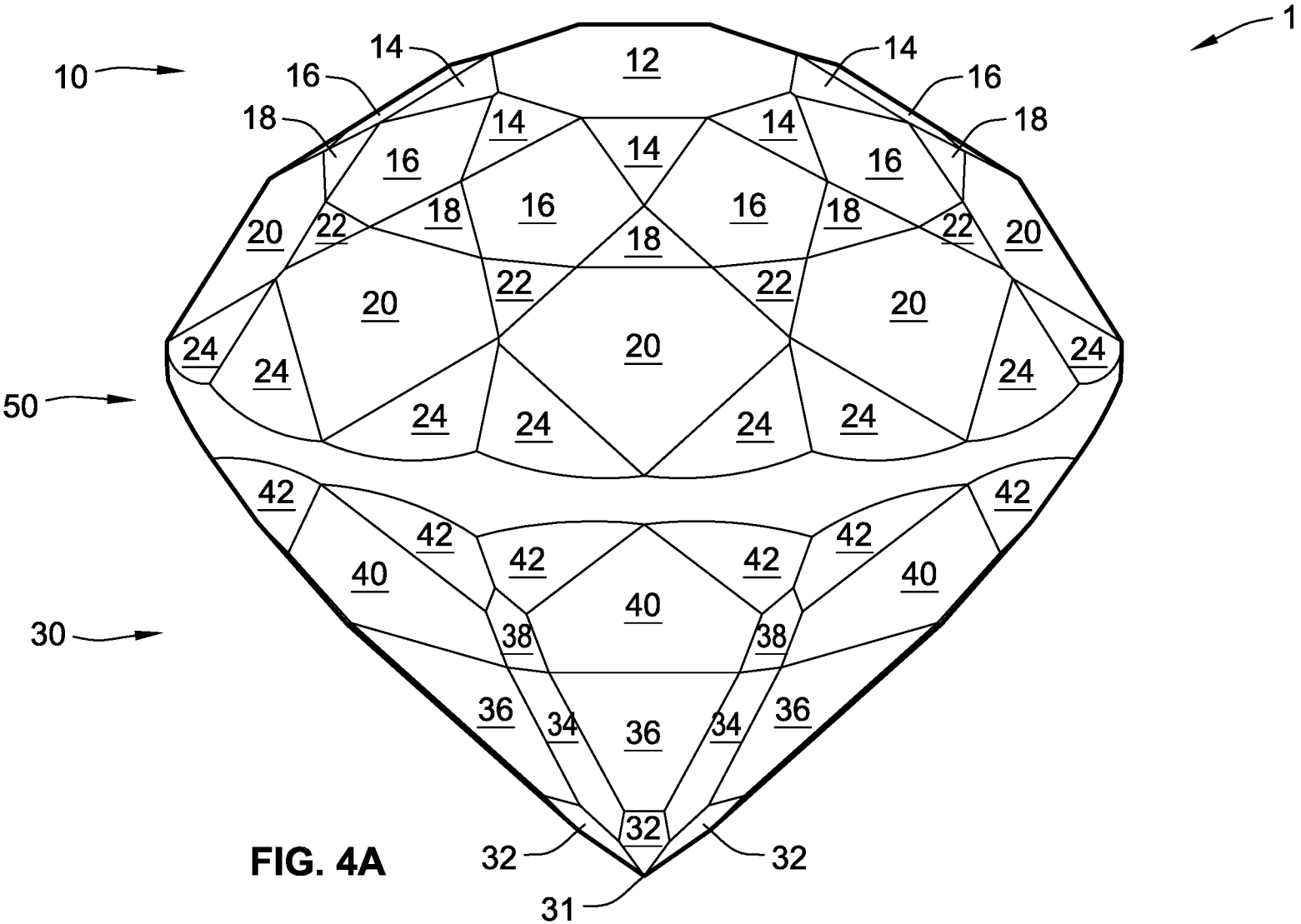
FIG. 4A is a perspective view of the gemstone of FIG. 1 viewed at a downward angle, according to some implementations of the present disclosure.
Figure 4B:
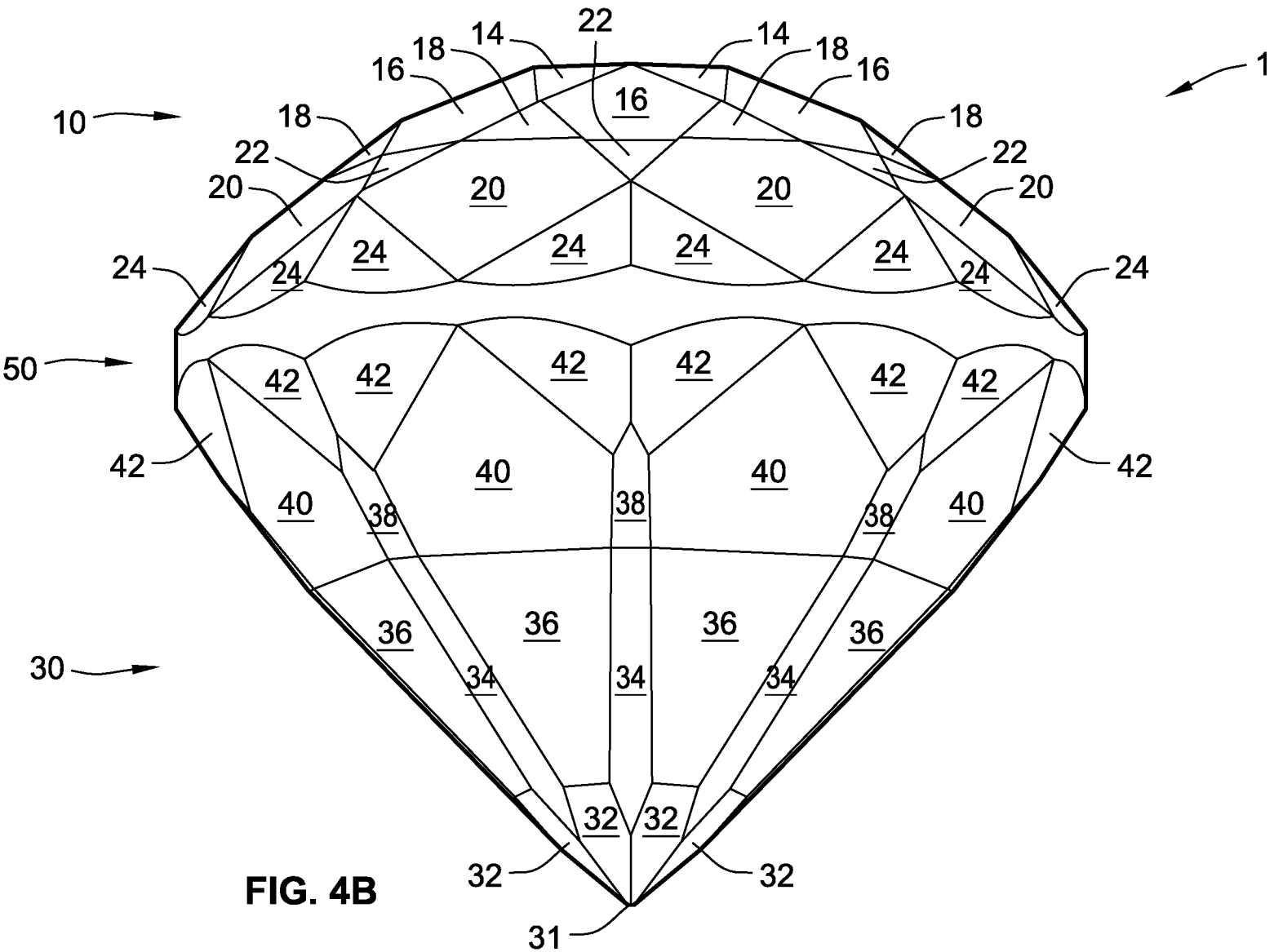
FIG. 4B is a perspective view of the gemstone of FIG. 1 viewed at an upward angle, according to some implementations of the present disclosure.

FIG. 4A illustrates a perspective view of gemstone 1 at a downward angle, while FIG. 4B illustrates a perspective view of gemstone 1 at an upward angle. The figures show the table 12, the star facets 14, the upper main crown facets 16, the upper intermediate crown facets 18, the lower main crown facets 20, the lower intermediate crown facets 22, the upper girdle facets 24, the culet-adjacent facets 32, the lower candle facets 34, the lower main pavilion facets 36, the upper candle facets 38, the upper main pavilion facets 40, the lower girdle facets 42, and the girdle 50.

Figure 5A:
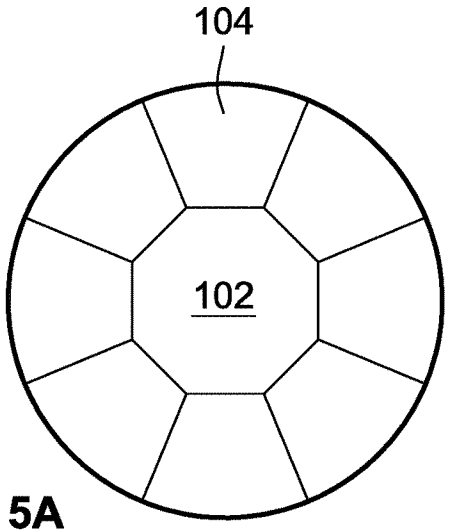
FIG. 5A illustrates a first step of a method of forming a crown of the gemstone of FIG. 1, according to some implementations of the present disclosure.

Referring now to FIGS. 5A-5F, the steps for forming the crown of the gemstone are illustrated. Generally, the gemstone may be formed from an uncut sample, which can have any shape. As shown in FIG. 5A, the first step includes forming a table 102 and a first set of crown facets 104. In an embodiment, the width of the table 102 is formed to be between about 30% and about 36% of the total width of the gemstone. In another embodiment, the width of the table 102 is formed to be about 21% to about 40% of the gemstone. The first set of crown facets 104 are formed at an angle of between about 46° and about 48°. In another embodiment, the first set of crown facets 104 may be formed at an angle of between about 44° and about 50°. The angle of the first set of crown facets 104 and the angles of subsequent crown facets formed in subsequent steps are measured relative to the horizontal plane that is defined by the table 102, similar to how the angles of the facets of the completed crown were measured in FIG. 1. After this step, the crown of the gemstone includes the table 102 and the first set of crown facets 104, and has a generally trapezoidal cross-section.

Figure 5B:
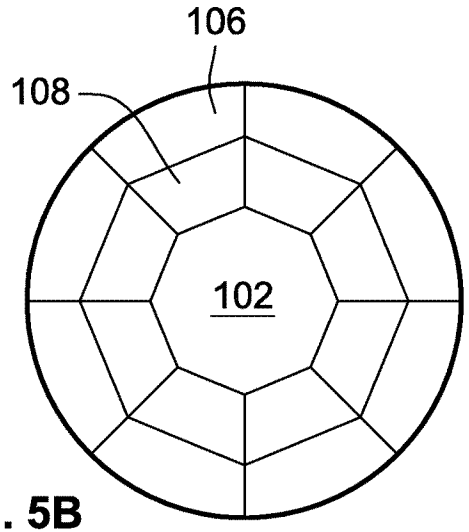
FIG. 5B illustrates a second step of the method of forming the crown of the gemstone of FIG. 1, according to some implementations of the present disclosure.

As shown in FIG. 5B, the next step in forming the gemstone is to make a second cut at a slightly shallower angle. This second cut divides the first set of crown facets 104 into a second set of crown facets 106 and a third set of crown facets 108. The second set of crown facets 106 generally comprise a lower portion of the first set of crown facets 104, while the third set of crown facets 108 generally comprise an upper portion of the first set of crown facets 104. In an embodiment, the third set of crown facets 108 are formed at an angle of between about 43° and about 45°. In another embodiment, the third set of crown facets 108 are formed at an angle of between about 41° and about 47°. The second set of crown facets 106 generally remains at the same angle as the first set of crown facets 104.

Figure 5C:
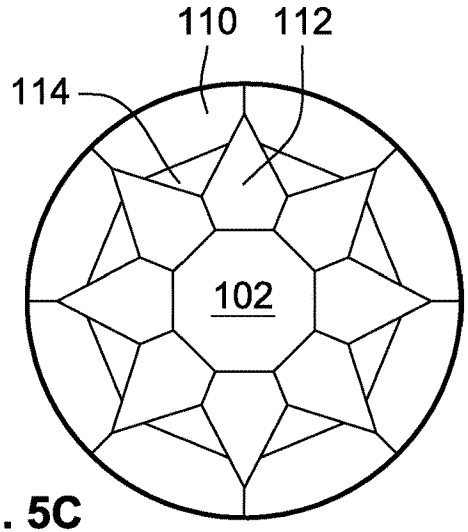
FIG. 5C illustrates a third step of the method of forming the crown of the gemstone of FIG. 1, according to some implementations of the present disclosure.

The next step is shown in FIG. 5C. Here, a fourth set of crown facets 110 is formed on the crown of the gemstone. The fourth set of crown facets 110 is formed by carving a pentagonal surface out portions of the second set of crown facets 106 and the third set of crown facets 108. The gemstone at this step is thus left with the fourth set of crown facets 110, a fifth set of crown facets 112, and a sixth set of crown facets 114. The fourth set of crown facets 110 is formed from the remainder of the second set of crown facets 106, and is formed at the same angle. The pentagonal surface forms the fifth set of crown facets 112, and can be formed at an angle of between about 32° and about 35°. In another embodiment, the fifth set of crown facets 112 are formed at an angle of between about 30° and about 37°. The sixth set of crown facets 114 each have a generally triangular shape, and are formed from the remainder of the third set of crown facets 108. Thus, the sixth set of crown facets 114 are generally disposed at the same angle as the third set of crown facets 108, which is between about 43° and about 45°, or between about 41° and about 47°. The sixth set of crown facets 114 will become the upper intermediate crown facets in the final gemstone.

Figure 5D:
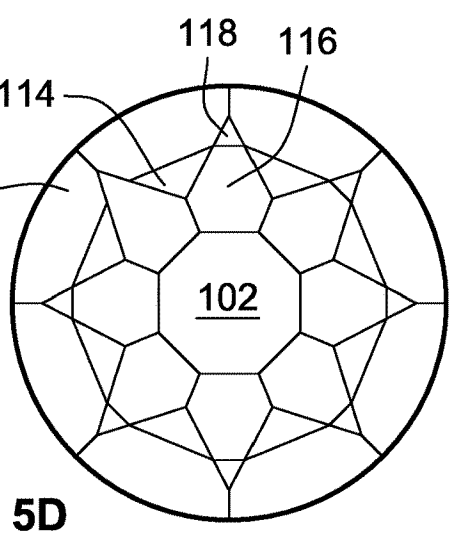
FIG. 5D illustrates a fourth step of the method of forming the crown of the gemstone of FIG. 1, according to some implementations of the present disclosure.

As shown in FIG. 5D, the next step is to carve out a triangular-shaped portion from the fifth set of crown facets 112. The remaining portions of the fifth set of crown facets 112 comprise the seventh set of crown facets 116, which have a general hexagonal shape. The seventh set of crown facets 116 may be formed at an angle of between about 32° and about 35°, or at an angle of between about 30° and about 37° which is the same angle as the fifth set of crown facets 112. The triangular-shaped portions carved out from the fifth set of crown facets 112 form the eighth set of crown facets 118, which are formed at an angle of between about 36° and about 39°. In another embodiment, the eighth set of crown facets 118 are formed at an angle of between about 34° and about 41°.

Figure 5E:
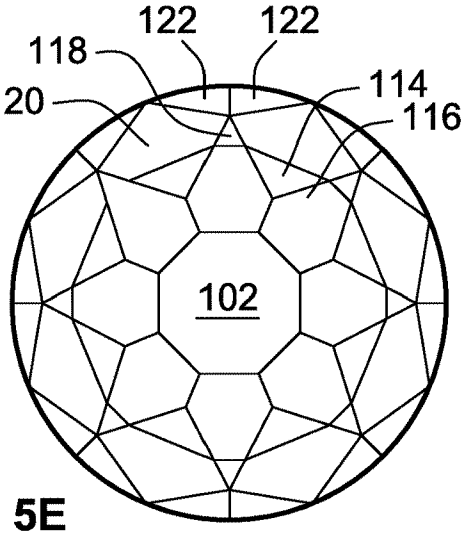
FIG. 5E illustrates a fifth step of the method of forming the crown of the gemstone of FIG. 1, according to some implementations of the present disclosure.

As shown in FIG. 5E, the next step is to carve out a ninth set of crown facets 120 and a tenth set of crown facets 122 from the fourth set of crown facets 110. The ninth set of crown facets 120 comprise the portions of the fourth set of crown facets 110 that are left behind after the upper girdle facets are carved out, and thus are formed at the same angle as the fourth set of crown facets 110. The tenth set of crown facets 122 generally correspond to the upper girdle facets of the final gemstone, and can be formed at an angle of between about 58° and about 60°. In another embodiment, the tenth set of crown facets 122 is formed at an angle of between about 56° and about 62°.

Figure 5F:
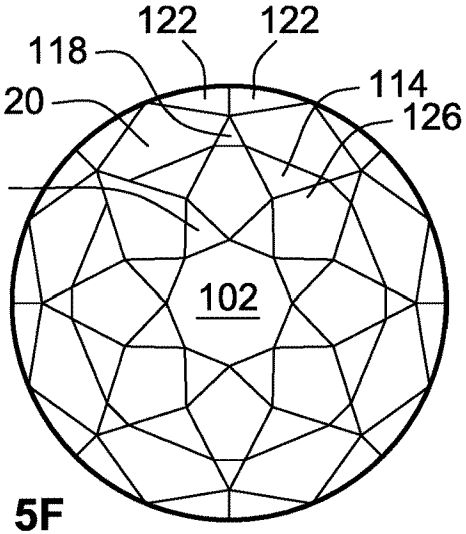

Finally, as shown in FIG. 5F, the final step in forming the crown of the gemstone is to carve out an eleventh set of crown facets 124 and a twelfth set of crown facets 126 from the seventh set of crown facets 116. The eleventh set of crown facets 124 are generally triangular shaped and are formed where adjacent ones of the seventh set of crown facets 116 meet. The eleventh set of crown facets 124 can be formed at an angle of about 25° to about 27°. In another embodiment, the eleventh set of crown facets 124 are formed at an angle of between about 23° and about 29°. The twelfth set of crown facets 126 are formed from the remainder of the seventh set of crown facets 116 and thus are formed at the same angle as the seventh set of crown facets 116.

As shown in FIG. 5F, the remaining set of facets in the crown correspond to the facets on the finished crown in FIG. 1. The sixth set of crown facets 114 corresponds to the upper intermediate crown facets. The eighth set of crown facets 118 corresponds to the lower intermediate crown facets. The ninth set of crown facets 120 corresponds to the lower main crown facets. The tenth set of crown facets 122 corresponds to the upper girdle facets. The eleventh set of crown facets 124 corresponds to the star facets. The twelfth set of crown facets 126 corresponds to the upper main crown facets. Generally, the angle of the twelfth set of crown facets 126 (corresponding to the upper main crown facets) will be less than the angle of the eighth set of crown facets 118 (corresponding to the lower intermediate crown facets), and the angle of the sixth set of crown facets 114 (corresponding to the upper intermediate crown facets) will be less than the angle of the ninth set of crown facets 120. Additionally, the angle of the tenth set of crown facets 122 (corresponding to the upper girdle facets) is generally greater than the angle of the other sets of crown facets.

Figure 6A:
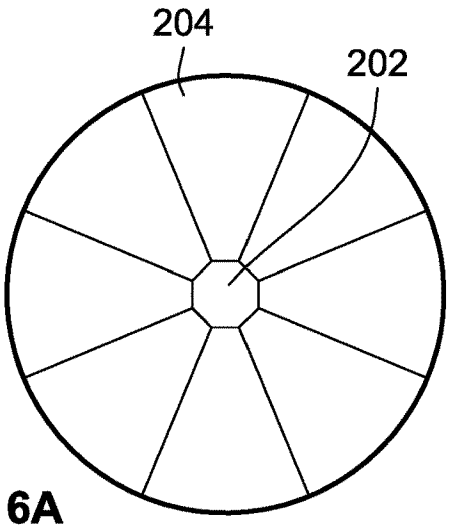
FIG. 6A illustrates a first step of a method of forming a pavilion of the gemstone of FIG. 1, according to some implementations of the present disclosure.

Referring now to FIGS. 6A-6F, the steps for forming the pavilion of the gemstone are illustrated. As shown in FIG. 6A, the first step includes forming a culet 202 and a first set of pavilion facets 204. The culet 202 may be formed as a bottom flat surface of the gemstone during the process of forming the pavilion, or may come pre-formed. The first set of pavilion facets 204 formed on the pavilion are formed at an angle of between about 50° and about 53°, or between about 48° and about 55°. The angle of the first set of pavilion facets 204 and the angles of subsequent pavilion facets formed in subsequent steps are also measured relative to the horizontal plane that is defined by the table 102 (shown in FIGS. 5A-5D), similar to how the angles of the facets of the completed pavilion were measured in FIG. 1. After this step, the pavilion of the gemstone has a culet 202 and a first set of pavilion facets 204, and generally has a trapezoidal cross-section.

Figure 6B:
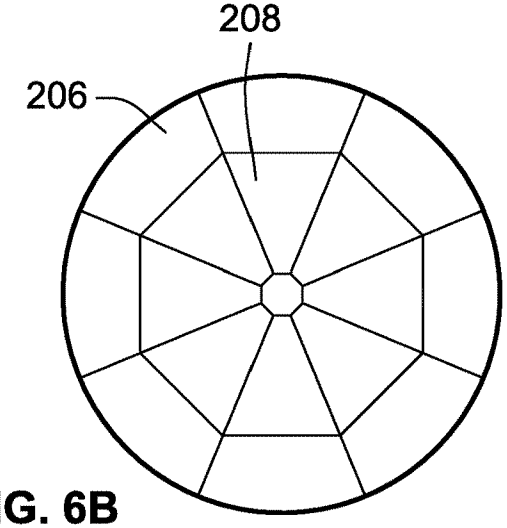
FIG. 6B illustrates a second step of the method of forming the pavilion of the gemstone of FIG. 1, according to some implementations of the present disclosure.

As shown in FIG. 6B, the next step in forming the pavilion is to make a second cut at a slightly shallower angle. This second cut leaves a portion of the first set of pavilion facets 204 behind, which are shown as second set of pavilion facets 206. The second cut also forms a third set of pavilion facets 208. The second set of pavilion facets 206 is generally formed at the same angle as the first set of pavilion facets 204. In an embodiment, the third set of pavilion facets 208 is formed at an angle between about 45° and about 48°. In another embodiment, the third set of pavilion facets 208 is formed at an angle between about 43° and about 50°.

Figure 6C:
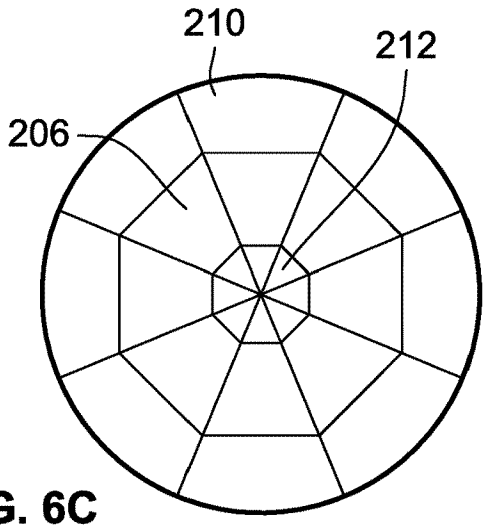
FIG. 6C illustrates a third step of the method of forming the pavilion of the gemstone of FIG. 1, according to some implementations of the present disclosure.

The step is shown in FIG. 6C. Here, a fourth set of pavilion facets 210 and a fifth set of pavilion facets 212 are formed from the third set of pavilion facets 208. At this step, a cut is made at an angle into the flat surface of the culet 202 to form the fifth set of pavilion facets 212. In an embodiment, the fifth set of pavilion facets 212 is formed at an angle of between about 41° and about 42°. In another embodiment, the fifth set of pavilion facets 212 is formed at an angle of between about 39° and about 44°. The fourth set of pavilion facets 210 comprises the remainder of the third set of pavilion facets 208, and thus is formed at generally the same angle as the third set of pavilion facets 208.

Figure 6D:
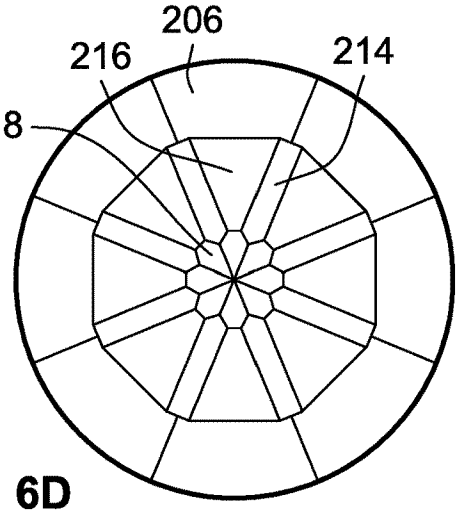
FIG. 6D illustrates a fourth step of the method of forming the pavilion of the gemstone of FIG. 1, according to some implementations of the present disclosure.

The next step, as shown in FIG. 6D, is to form a sixth set of pavilion facets 214 on the pavilion of the gemstone. The sixth set of pavilion facets 214 is formed along the edges joining adjacent pairs of the fourth set of pavilion facets 210. The sixth set of pavilion facets 214 thus reduces the size of the fourth set of pavilion facets 210 to form a seventh set of pavilion facets 216. The sixth set of pavilion facets 214 also cuts into the fifth set of pavilion facets 212, forming an eighth set of pavilion facets 218. The seventh set of pavilion facets 216 is generally formed at the same angle as the fourth set of pavilion facets 210. The eighth set of pavilion facets 218 is generally formed at the same angle as the fifth set of pavilion facets 212. In an embodiment, the sixth set of pavilion facets 214 is formed at an angle of between about 44° and about 45°. In another embodiment, the sixth set of pavilion facets 214 is formed at an angle of between about 42° and about 47°.

Figure 6E:
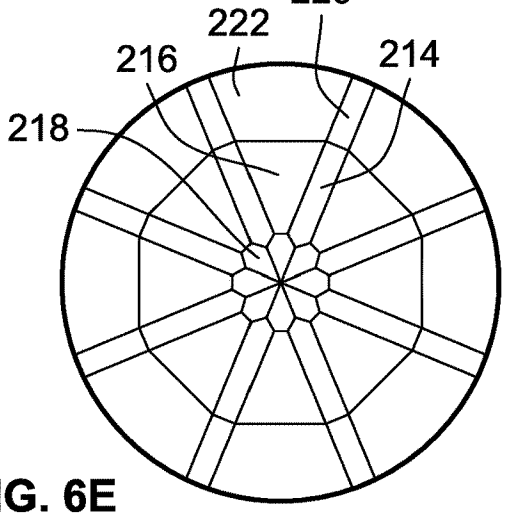
FIG. 6E illustrates a fifth step of the method of forming the pavilion of the gemstone of FIG. 1, according to some implementations of the present disclosure.

Next, as shown in FIG. 6E, a ninth set of pavilion facets 220 is formed. The ninth set of pavilion facets 220 is formed at the edges shared between adjacent facets of the second set of pavilion facets 206 and overlaps with the second set of pavilion facets 206. Forming the ninth set of pavilion facets 220 thus forms a tenth set of pavilion facets 222 that comprises the remaining portion of the second set of pavilion facets 206. The tenth set of pavilion facets 222 is generally formed at the same angle as the second set of pavilion facets 206. In an embodiment, the ninth set of pavilion facets 220 is formed at an angle of between about 48° and about 51°. In another embodiment, the ninth set of pavilion facets 220 is formed at an angle of between about 46° and about 53°.

Figure 6F:
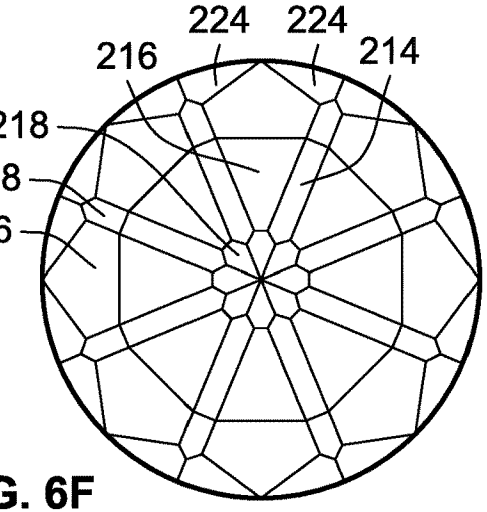
FIG. 6F illustrates a sixth step of the method of forming the crown of the gemstone of FIG. 1, according to some implementations of the present disclosure.

Finally, as shown in FIG. 6F, an eleventh set of pavilion facets 224 are formed. The eleventh set of pavilion facets 224 are carved out of the ninth set of pavilion facets 220 and the tenth set of pavilion facets 222. Thus, a twelfth set of pavilion facets 226 and a thirteenth set of pavilion facets 228 are also formed. The twelfth set of pavilion facets 226 is formed from the remainder of the tenth set of pavilion facets 222, and thus is formed at generally the same angle as the tenth set of pavilion facets 222. The thirteenth set of pavilion facets 228 is formed from the remainder of the ninth set of pavilion facets 220, and thus is formed at generally the same angle as the ninth set of pavilion facets 220. In an embodiment, the eleventh set of pavilion facets 224 is formed at an angle of between about 55° to about 58°. In a further embodiment, the eleventh set of pavilion facets 224 is formed at an angle of between about 53° and about 60°.

As shown in FIG. 6F, the sixth set of pavilion facets 214 corresponds to the lower candle facets on the finished pavilion in FIG. 1. The seventh set of pavilion facets 216 corresponds to the lower main pavilion facets. The eighth set of pavilion facets 218 corresponds to the culet-adjacent facets. The eleventh set of pavilion facets 224 corresponds to the lower girdle facets. The twelfth set of pavilion facets 226 corresponds to the upper main pavilion facets. The thirteenth set of pavilion facets 228 corresponds to the upper candle facets. Generally, the angle of the eighth set of pavilion facets 218 (corresponding to the culet-adjacent facets) is less than the angle of the sixth set of pavilion facets 214 (corresponding to the lower candle facets) and the angle of seventh set of pavilion facets 216 (corresponding to the lower main pavilion facets). Moreover, the angle of the sixth set of pavilion facets 214 is generally less than the angle of the thirteenth set of pavilion facets 228 (corresponding to the upper candle facets), while the angle of the seventh set of pavilion facets 216 is generally less than the angle of the twelfth set of pavilion facets 226 (corresponding to the upper main pavilion facets). Finally, the angle of the eleventh set of pavilion facets 224 (corresponding to the lower girdle facets) is generally greater than the angle of the other sets of pavilion facets.

Thus, a gemstone having a crown, a girdle, and a pavilion are thus formed. The crown and the pavilion comprise a number of sets of interlocking facets that share edges and vertices on the surface of the gemstone. Each of the sets of interlocking facets is disposed at a specific angle. The shape of the facets, the organization of the facets, and the angles that the facets are formed at on the surface of the gemstone result in a gemstone having an improved brilliance. The brilliance refers to the amount of light that enters the gemstone, and is internally reflected such that it exits out of the crown of the gemstone. The facets according to aspects of the present disclosure increase the amount of light reflecting off of the internal surfaces of the facets, thus increasing the brilliance of the gemstone. The facets also give the gemstone a distinct golden or yellow color.

While the present disclosure has been described with reference to one or more particular embodiments, those skilled in the art will recognize that many changes may be made thereto without departing from the spirit and scope of the present disclosure. Each of these embodiments and obvious variations thereof is contemplated as falling within the spirit and scope of the present disclosure. It is also contemplated that additional embodiments according to aspects of the present disclosure may combine any number of features from any of the embodiments described herein.

What is claimed is:

1. A gemstone comprising:

a crown forming an upper portion of the gemstone, a surface of the crown including:

a table forming a generally horizontal upper surface of the crown;

a plurality of star facets, each of the plurality of star facets being disposed adjacent to and abutting an edge of the table;

a plurality of upper main crown facets, each of the upper main crown facets being disposed generally between two of the plurality of star facets;

a plurality of upper intermediate crown facets, each of the upper intermediate crown facets being disposed generally between two of the plurality of upper main crown facets;

a plurality of lower main crown facets, each of the plurality of lower main crown facets being disposed adjacent to and abutting an edge of one of the plurality of upper intermediate crown facets;

a plurality of lower intermediate crown facets, each of the plurality of lower intermediate crown facets being disposed adjacent to and abutting an edge of one of the plurality of upper main crown facets and being disposed generally between two of the plurality of lower main crown facets; and a plurality of upper girdle facets formed in pairs of adjacent upper girdle facets, each pair of adjacent upper girdle facets being disposed generally between two of the plurality of lower main crown facets;

a pavilion forming a lower portion of the gemstone, a surface of the pavilion including:

a plurality of culet-adjacent facets forming a lower point of the pavilion;

a plurality of lower main pavilion facets, each of the lower main pavilion facets being disposed adjacent to and abutting an edge of one of the plurality of culet-adjacent facets;

a plurality of lower candle facets, an upper portion of each of the plurality of lower candle facets being disposed generally between two of the plurality of lower main pavilion facets and a lower portion of each of the plurality of lower candle facets being disposed generally between two of the plurality of culet-adjacent facets;

a plurality of upper main pavilion facets, each of the upper main pavilion facets being disposed adjacent to and abutting an edge of one of the plurality of lower main pavilion facets;

a plurality of upper candle facets, each of the plurality of upper candle facets being disposed adjacent to and abutting an edge of one of the plurality of lower candle facets and a lower portion of each of the plurality of upper candle facets being disposed generally between two of the plurality of upper main pavilion facets; and a plurality of lower girdle facets formed in pairs of adjacent lower girdle facets, each pair of adjacent lower girdle facets between disposed generally between two of the plurality of upper main pavilion facets, each pair of adjacent lower girdle facets having an upper portion of a respective one of the plurality of upper candle facets disposed generally therebetween; and a girdle positioned between the crown and the pavilion and encircling the gemstone, each of the plurality of upper girdle facets being disposed adjacent to and abutting an upper edge of the girdle and each of the plurality of lower girdle facets being disposed adjacent to and abutting a lower edge of the girdle.

2. The gemstone of claim 1, wherein the gemstone has a table percentage between about thirty-three percent and about thirty-six percent.

3. The gemstone of claim 1, wherein the gemstone has a top depth percentage between about twenty-seven percent and about thirty-one percent.

4. The gemstone of claim 1, wherein the gemstone has a bottom depth percentage between about fifty-three percent to about fifty-six percent.

5. The gemstone of claim 1, wherein the gemstone has a total depth percentage between about eighty-six percent and about ninety-one percent.

6. The gemstone of claim 1, wherein the gemstone has a girdle thickness percentage between about three percent and about eight percent.

7. The gemstone of claim 1, wherein a horizontal plane is defined by the table of the gemstone, and wherein each of the plurality of star facets is disposed at a first angle relative to the horizontal plane, each of the plurality of upper main crown facets is disposed at a second angle relative to the horizontal plane, each of the plurality of upper intermediate crown facets is disposed at a third angle relative to the horizontal plane, each of the plurality of lower main crown facets is disposed at a fourth angle relative to the horizontal plane, each of the plurality of lower intermediate crown facets is disposed at a fifth angle relative to the horizontal plane, and each of the plurality of upper girdle facets is disposed at a sixth angle relative to the horizontal plane.

8. The gemstone of claim 7, wherein first angle is between about twenty-five degrees and about twenty-seven degrees, wherein the second angle is between about thirty-two degrees and about thirty-five degrees, wherein the third angle is between about forty-three degrees and about forty-five degrees, wherein the fourth angle is between about forty-six degrees and about forty-eight degrees, wherein the fifth angle is between about thirty-six degrees and about thirty-nine degrees, and wherein the sixth angle is between about fifty-one degrees and about fifty-three degrees.

9. The gemstone of claim 1, wherein a horizontal plane is defined by the table of the gemstone, and wherein each of plurality of culet-adjacent facets is disposed at a first angle relative to the horizontal plane, each of plurality of lower candle facets is disposed at a second angle relative to the horizontal plane, each of plurality of lower main pavilion facets is disposed at a third angle relative to the horizontal plane, each of plurality of upper candle facets is disposed at a fourth angle relative to the horizontal plane, each of the plurality of upper main pavilion facets is disposed at a fifth angle relative to the horizontal plane, and each of the plurality of lower girdle facets is disposed at a sixth angle relative to the horizontal plane.

10. The gemstone of claim 9, wherein the first angle is about forty-two degrees, wherein second angle is between about forty-four degrees and about forty-five degrees, wherein the third angle is between about forty-five degrees and about forty-eight degrees, wherein the fourth angle is between about forty-eight degrees and about fifty-one degrees, wherein the fifth angle is between about fifty degrees and about fifty-three degrees, wherein the sixth angle is between about fifty-five degrees and about fifty-eight degrees.

11. A gemstone comprising:

a crown forming an upper portion of the gemstone, a surface of the crown including:

a table forming a generally horizontal upper surface of the crown;

a plurality of star facets, each of the plurality of star facets being disposed adjacent to and abutting an edge of the table;

a plurality of upper main crown facets, each of the upper main crown facets being disposed generally between two of the plurality of star facets;

a plurality of upper intermediate crown facets, each of the upper intermediate crown facets being disposed generally between two of the plurality of upper main crown facets;

a plurality of lower main crown facets, each of the plurality of lower main crown facets being disposed adjacent to and abutting an edge of one of the plurality of upper intermediate crown facets;

a plurality of lower intermediate crown facets, each of the plurality of lower intermediate crown facets being disposed adjacent to and abutting an edge of one of the plurality of upper main crown facets and being disposed generally between two of the plurality of lower main crown facets; and a plurality of upper girdle facets formed in pairs of adjacent upper girdle facets, each pair of adjacent upper girdle facets being disposed generally between two of the plurality of lower main crown facets; and a pavilion forming a lower portion of the gemstone, a surface of the pavilion including:

a plurality of culet-adjacent facets forming a lower point of the pavilion;

a plurality of lower main pavilion facets, each of the lower main pavilion facets being disposed adjacent to and abutting an edge of one of the plurality of culet-adjacent facets;

a plurality of lower candle facets, an upper portion of each of the plurality of lower candle facets being disposed generally between two of the plurality of lower main pavilion facets and a lower portion of each of the plurality of lower candle facets being disposed generally between two of the plurality of culet-adjacent facets;

a plurality of upper main pavilion facets, each of the upper main pavilion facets being disposed adjacent to and abutting an edge of one of the plurality of lower main pavilion facets;

a plurality of upper candle facets, each of the plurality of upper candle facets being disposed adjacent to and abutting an edge of one of the plurality of lower candle facets and a lower portion of each of the plurality of upper candle facets being disposed generally between two of the plurality of upper main pavilion facets; and a plurality of lower girdle facets formed in pairs of adjacent lower girdle facets, each pair of adjacent lower girdle facets between disposed generally between two of the plurality of upper main pavilion facets, each pair of adjacent lower girdle facets having an upper portion of a respective one of the plurality of upper candle facets disposed generally therebetween.

12. The gemstone of claim 11, wherein a horizontal plane is defined by the table of the gemstone, and wherein each of the plurality of star facets is disposed at a first angle relative to the horizontal plane, each of the plurality of upper main crown facets is disposed at a second angle relative to the horizontal plane, each of the plurality of upper intermediate crown facets is disposed at a third angle relative to the horizontal plane, each of the plurality of lower main crown facets is disposed at a fourth angle relative to the horizontal plane, each of the plurality of lower intermediate crown facets is disposed at a fifth angle relative to the horizontal plane, and each of the plurality of upper girdle facets is disposed at a sixth angle relative to the horizontal plane.

13. The gemstone of claim 12, wherein first angle is between about twenty-five degrees and about twenty-seven degrees, wherein the second angle is between about thirty-two degrees and about thirty-five degrees, wherein the third angle is between about forty-three degrees and about forty-five degrees, wherein the fourth angle is between about forty-six degrees and about forty-eight degrees, wherein the fifth angle is between about thirty-six degrees and about thirty-nine degrees, and wherein the sixth angle is between about fifty-one degrees and about fifty-three degrees.

14. The gemstone of claim 11, wherein the gemstone has a table percentage between about thirty-three percent and about thirty-six percent.

15. The gemstone of claim 11, wherein the gemstone has a top depth percentage between about twenty-seven percent and about thirty-one percent.

16. The gemstone of claim 11, wherein a horizontal plane is defined by the table of the gemstone, and wherein each of plurality of culet-adjacent facets is disposed at a first angle relative to the horizontal plane, each of plurality of lower candle facets is disposed at a second angle relative to the horizontal plane, each of plurality of lower main pavilion facets is disposed at a third angle relative to the horizontal plane, each of plurality of upper candle facets is disposed at a fourth angle relative to the horizontal plane, each of the plurality of upper main pavilion facets is disposed at a fifth angle relative to the horizontal plane, and each of the plurality of lower girdle facets is disposed at a sixth angle relative to the horizontal plane.

17. The gemstone of claim 16, wherein the first angle is about forty-two degrees, wherein second angle is between about forty-four degrees and about forty-five degrees, wherein the third angle is between about forty-five degrees and about forty-eight degrees, wherein the fourth angle is between about forty-eight degrees and about fifty-one degrees, wherein the fifth angle is between about fifty degrees and about fifty-three degrees, wherein the sixth angle is between about fifty-five degrees and about fifty-eight degrees.

18. The gemstone of claim 11, wherein the gemstone has a bottom depth percentage between about fifty-three percent to about fifty-six percent.

19. A gemstone comprising:

a crown forming an upper portion of the gemstone, a surface of the crown including:

a table forming a generally horizontal upper surface of the crown, the table having a generally octagonal shape;

a plurality of star facets, each of the plurality of star facets being disposed adjacent to and abutting an edge of the table, each of the plurality of star facets having a generally triangular shape;

a plurality of upper main crown facets, each of the upper main crown facets being disposed generally between two of the plurality of star facets, each of the plurality of star upper main crown facets having a generally pentagonal shape;

a plurality of upper intermediate crown facets, each of the upper intermediate crown facets being disposed generally between two of the plurality of upper main crown facets, each of the plurality of upper intermediate crown facets having a generally triangular shape;

a plurality of lower main crown facets, each of the plurality of lower main crown facets being disposed adjacent to and abutting an edge of one of the plurality of upper intermediate crown facets, each of the plurality of lower main crown facets having a generally pentagonal shape;

a plurality of lower intermediate crown facets, each of the plurality of lower intermediate crown facets being disposed adjacent to and abutting an edge of one of the plurality of upper main crown facets and being disposed generally between two of the plurality of lower main crown facets, each of the plurality of lower intermediate crown facets having a generally triangular shape; and a plurality of upper girdle facets formed in pairs of adjacent upper girdle facets, each pair of adjacent upper girdle facets being disposed generally between two of the plurality of lower main crown facets, each of the plurality of upper girdle facets having a generally triangular shape;

a pavilion forming a lower portion of the gemstone, a surface of the pavilion including:

a plurality of culet-adjacent facets forming a lower point of the pavilion, each of the plurality of culet-adjacent facets having a generally pentagonal shape with a flat edge opposing the lower point of the pavilion;

a plurality of lower main pavilion facets, each of the lower main pavilion facets being disposed adjacent to and abutting an edge of one of the plurality of culet-adjacent facets, each of the plurality of lower main pavilion facets having a generally trapezoidal shape;

a plurality of lower candle facets, an upper portion of each of the plurality of lower candle facets being disposed generally between two of the plurality of lower main pavilion facets and a lower portion of each of the plurality of lower candle facets being disposed generally between two of the plurality of culet-adjacent facets, each of the plurality of lower candle facets having a generally pentagonal shape;

a plurality of upper main pavilion facets, each of the upper main pavilion facets being disposed adjacent to and abutting an edge of one of the plurality of lower main pavilion facets, each of the plurality of upper main pavilion facets having a generally pentagonal shape with a lower horizontal edge and an upper point;

a plurality of upper candle facets, each of the plurality of upper candle facets being disposed adjacent to and abutting an edge of one of the plurality of lower candle facets and a lower portion of each of the plurality of upper candle facets being disposed generally between two of the plurality of upper main pavilion facets, each of the plurality of upper candle facets having a generally pentagonal shape; and a plurality of lower girdle facets formed in pairs of adjacent lower girdle facets, each pair of adjacent lower girdle facets between disposed generally between two of the plurality of upper main pavilion facets, each pair of adjacent lower girdle facets having an upper portion of a respective one of the plurality of upper candle facets disposed generally therebetween, each of the plurality of lower girdle facets having four edges; and a girdle positioned between the crown and the pavilion and encircling the gemstone, each of the plurality of upper girdle facets being disposed adjacent to and abutting an upper edge of the girdle and each of the plurality of lower girdle facets being disposed adjacent to and abutting a lower edge of the girdle.

* * * * *